US005122089A

United States Patent [19]

Haran

[11] Patent Number: 5,122,089

[45] Date of Patent: Jun. 16, 1992

[54] SPIN TOP

[76] Inventor: David Haran, 4 Stein Street, Tel Aviv 65147, Israel

[21] Appl. No.: 408,271

[22] Filed: Sep. 18, 1989

[30] Foreign Application Priority Data

Sep. 23, 1988 [IL] Israel ..... 87852

[51] Int. Cl.[5] ..... A63H 1/00

[52] U.S. Cl. ..... 446/257; 446/259

[58] Field of Search ..... D21/95; 273/94, 129 P, 273/129 R; 446/257, 258, 259

[56] References Cited

U.S. PATENT DOCUMENTS

| | | | |
|---|---|---|---|
| 191,701 | 6/1877 | McLaughlin | 446/258 X |
| D. 237,521 | 11/1975 | Tremblay | D21/95 |
| 825,890 | 7/1904 | Bristow | 273/129 P |
| 2,828,964 | 4/1958 | Horton | 273/94 |
| 2,839,869 | 6/1958 | Lopez | 446/257 X |
| 3,018,584 | 1/1962 | Passariello | 273/129 P X |
| 3,952,442 | 4/1976 | Livesey et al. | 273/129 P X |

FOREIGN PATENT DOCUMENTS

| | | |
|---|---|---|
| 24486 | 3/1883 | Fed. Rep. of Germany . |
| 402579 | 4/1909 | France . |
| 1169838 | 3/1957 | France . |
| 2054761 | 4/1971 | France . |

*Primary Examiner*—Robert A. Hafer
*Assistant Examiner*—Sam Rimell
*Attorney, Agent, or Firm*—Oblon, Spivak, McClelland, Maier & Neustadt

[57] ABSTRACT

A spin-top which includes a body of substantially rotational symmetry around a longitudinal axis, the body having a curved outer surface for converting force having a vertical component applied thereto into a rotational force, the top being provided with at least one pointed end face along the axis and the top being configured to have a first rest position with the axis substantially parallel with the ground, a second active position with the axis substantially perpendicular to the ground and an intermediate active position of rotation around the axis while the axis is still substantially parallel with the ground, the configuration of the top being such that upon application of a spin imparting force to the outer wall of the body while in the first rest position, the body is imparted with a forward motion combined with a backward spin to achieve the intermediate active position while also being imparted with a simultaneous turning motion around some point along its axis, a gyroscopic reaction causing the top to subsequently assume the second active position with the top continuing to spin about a vertical axis.

8 Claims, 2 Drawing Sheets

SPIN TOP

BACKGROUND OF THE INVENTION

1. Field of the Invention

The present invention relates to a toy spin top. More particularly the present invention relates to a toy spin top, configured to achieve translation from a horizontal to a vertical axis of rotation and to be actuated by the foot. hand or finger of the user.

2. Discussion of the Background

A favorite toy among the young at heart is the spin top, this toy providing entertainment and challenge to children who test their skill in maintaining the top in motion, while babies and the very young find interest and amusement in watching its movements. Children can also compete against each other with regard to the length of time they can maintain the top in motion.

A number of methods are known for imparting to the top the angular impulse needed to provide momentum sufficient to overcome friction and windage losses for a while. A small top provided with a thin stem on the upper part of its axis may be set in motion by twisting the stem between the fingers. A larger top may be set spinning by applying a couple to its body by using two hands. A string may be wound around a top, the rapid release therefrom having the same effect.

A screw-rod provided with a screw-thread having a very large helix angle may project from the upper part of the top, a female screw thread in the body of the top acting to convert axial pressure and movement of the screw rod into rotary motion, similar to the action of a push drill. A whip can be used to maintain the spinning motion of a top. Lastly, a coiled spring may be used which, on release, imparts angular motion to the top for its activation.

All of these methods of actuation result in a top which operates with its axis of rotation substantially vertical until near the exhaustion of the stored angular momentum.

It is one of the objects of the present invention to provide a simple, durable spin top, having the novel features of translation from a horizontal to a vertical axis of rotation when in use, and to be actuated by the foot, hand or finger of the user.

SUMMARY OF THE INVENTION

The top is suitable for indoor use in its smaller sizes and for outdoor use when of larger size. These objects are achieved by the present invention by providing a spin-top comprising a body of substantially rotational symmetry around a longitudinal axis, said body having a curved outer surface for converting force having a vertical component applied thereto into a rotational force, said top being provided with at least one pointed end face along said axis and said top being configured to have a first rest position with said axis substantially parallel with the ground, a second active position with said axis substantially perpendicular to the ground and an intermediate active position of rotation around said axis while said axis is still substantially parallel with the ground, the configuration of said top being such that upon application of a spin imparting force to the outer wall of said body while in said first rest position, said body is imparted with a forward motion combined with a backward spin to achieve said intermediate active position while also being imparted with a simultaneous turning motion around some point along its axis, a gyroscopic reaction causing the top to subsequently assume said second active position with said top continuing to spin about a vertical axis.

In a preferred embodiment of the invention, a number of spin tops are nested one inside the other, actuation of the outer top causing ejection and actuation of all inner tops.

In an especially preferred embodiment of the present invention there is provided a foot actuatable spin-top comprising a body of substantially rotational symmetry, provided with at least one pointed end face, the configuration of said top being such that upon application of a force to the outer wall of said body as a result of a stamping action, said body is imparted with a forward motion combined with a backward spin and a simultaneous turning motion around some point along its axis, a gyroscopic reaction causing the top to assume a vertical position and said top continuing to spin about said axis.

Said body is preferably cylindrical in shape having a semispherical or conical end provided with a point at its apex.

Alternatively said body can be semispherical or conical or any other similar shape, as long as the overall configuration of the body is such as to enable its use as described herein. Thus it will be realized that with a spin top of conical configuration the longitudinal axis will be at an acute angle with the ground in its first rest position and in its intermediate active position and such an acute angle of e.g. 30° is intended to be included in the present definition of the rest position of the top, which definition is in contradistinction to the first rest position of most tops which immediately prior to activation are held with their longitudinal axis substantially perpendicular with the ground.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
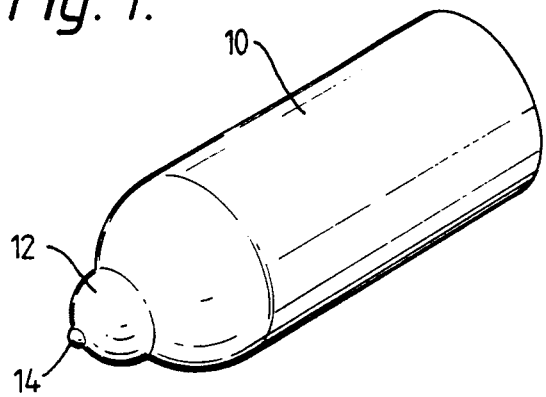
FIG. 1 shows a perspective view of a first embodiment of the invention.

There is seen in FIG. 1 a cylindrical body 10, one end 12 having a rounded form although other shapes for the body as a whole, such as a cone, or a single hemisphere, would be equally acceptable. A small hard point 14 is provided at the apex. A suitable material for the body of the spin top is a solid polyurethane polymer, this material providing the abrasion resistance required for long term use.

In operation of the embodiment of FIG. 1, the spin-top is laid on a hard flat surface. The user aligns his or her foot with the body 10, at a position away from the pointed end 12, the axis of body 10 being at right angles to the length of the foot or shoe. Foot pressure is then applied in a stamping motion and the following chain of events then ensues:

a. The spin-top assumes a forward motion, and rapidly exits from under the foot in the general direction in which the foot points.

b. The spin-top proceeds to revolve about its own axis, the direction of revolution being such that the outer surface skids over the flat surface over which it moves.

c. The forward velocity of that part of the spin-top at which the foot pressure is applied is greater than the forward velocity of the pointed end, the immediate result being that the axis of spin is turned in direction.

d. A gyroscope reaction to this turn causes the axis of the spinning top to assume a substantially vertical position.

e. In the vertical position the frictional energy losses which decelerate the spin velocity comprise friction between the small hard point 14 and the flat surface and windage losses. The top continues to spin until the stored kinetic energy of revolution about its axis has virtually been exhausted.

While the preferred embodiment of the present invention is one which is foot actuated by stamping, smaller versions of the top could be actuated by hand or even finger pressure applied thereto in an analogous manner.

Figure 2:
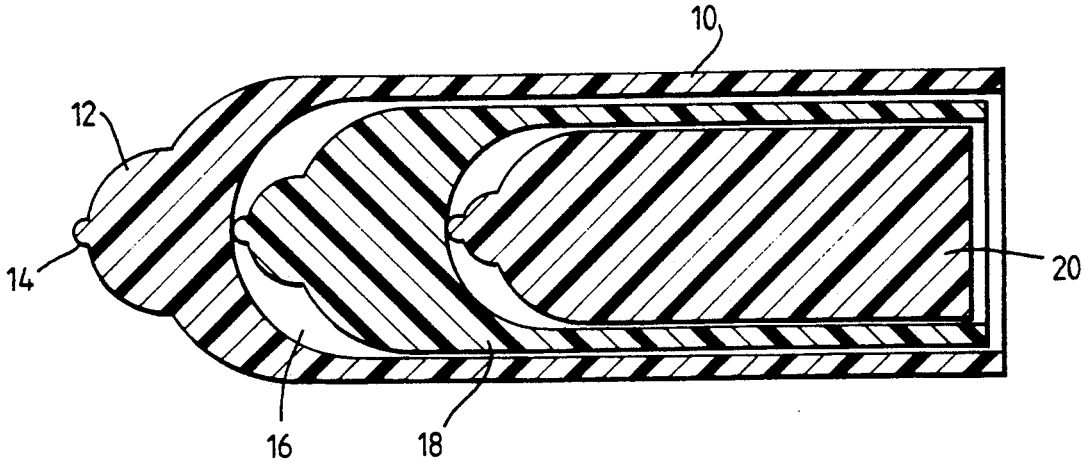
FIG. 2 is a cross-sectional view of a second embodiment.

FIG. 2 shows a second embodiment of the invention in a cross-sectional view. The body 10 is provided with a cylindrical hollow 16. A second spin-top 18 has dimensions which allow it free insertion into hollow 16. A third spin-top 20 nests in the hollow of spin-top 18. All three spin tops are preferably of similar shape. Third spin-top 20 may have a solid body without a hollow and the tops can be of different shape as long as nesting is achieved.

The operation of the spin top shown in FIG. 2 is of a generally similar nature. However, the change in axis direction described results in the application of a centrifugal force on the small inner tops 18 and 20, this centrifugal force acting along the axis of the tops and causing ejection of all smaller tops and complete separation of all tops, all of which assume an upright position and continue to spin independently.

Thus with a multiplicity of nested spin-tops, at least one pair of tops can be provided with engagement means (not shown) for transmitting rotational acceleration from an outer to an inner spin top or the end of an inner spin top can extend beyond the end of an outer spin top for independent activation as described hereinafter with reference to FIG. 5.

Figure 3:
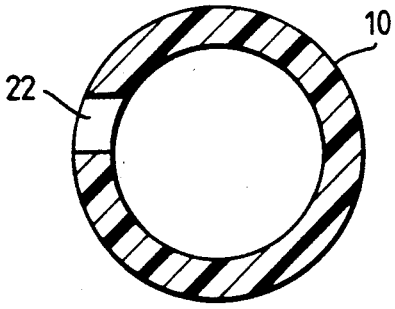
FIG. 3 is a cross-sectional view of the body of a third embodiment.

FIG. 3 is a cross-sectional view of a third embodiment. The top body 10 is provided with at least one air entry port 22 on its outer periphery In use, air entering port 22 is caused to vibrate producing a whistle or hum, air entry being caused by the rapid revolution of the outer periphery.

Figure 4:
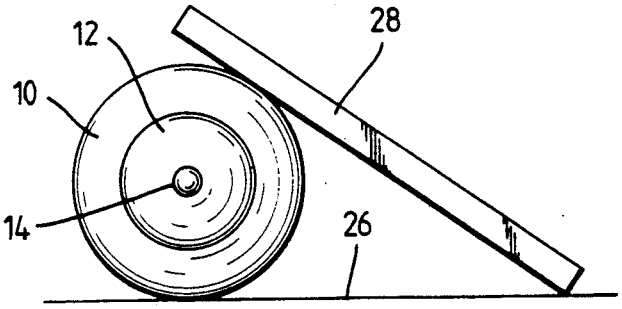
FIG. 4 is a side view of a spin top according to the invention in combination with a foot-board activator.

FIG. 4 shows a spin-top resting on flat surface 26. A foot-board 28 rests on the cylindrical body 10 and on flat surface 26 at an angle. The length of the foot-board 28 is two to four times the diameter of body 10, while its width could be 3 to 10 cm.

The operation of the foot board is similar to that of the foot itself, in the transfer of the actuation forces. A first advantage over the plain foot is that it is more comfortable for the foot to apply pressure on the flat board than on a cylindrical spin-top. A second advantage lies in the high exit velocity achieved by use of the board.

Figure 5:
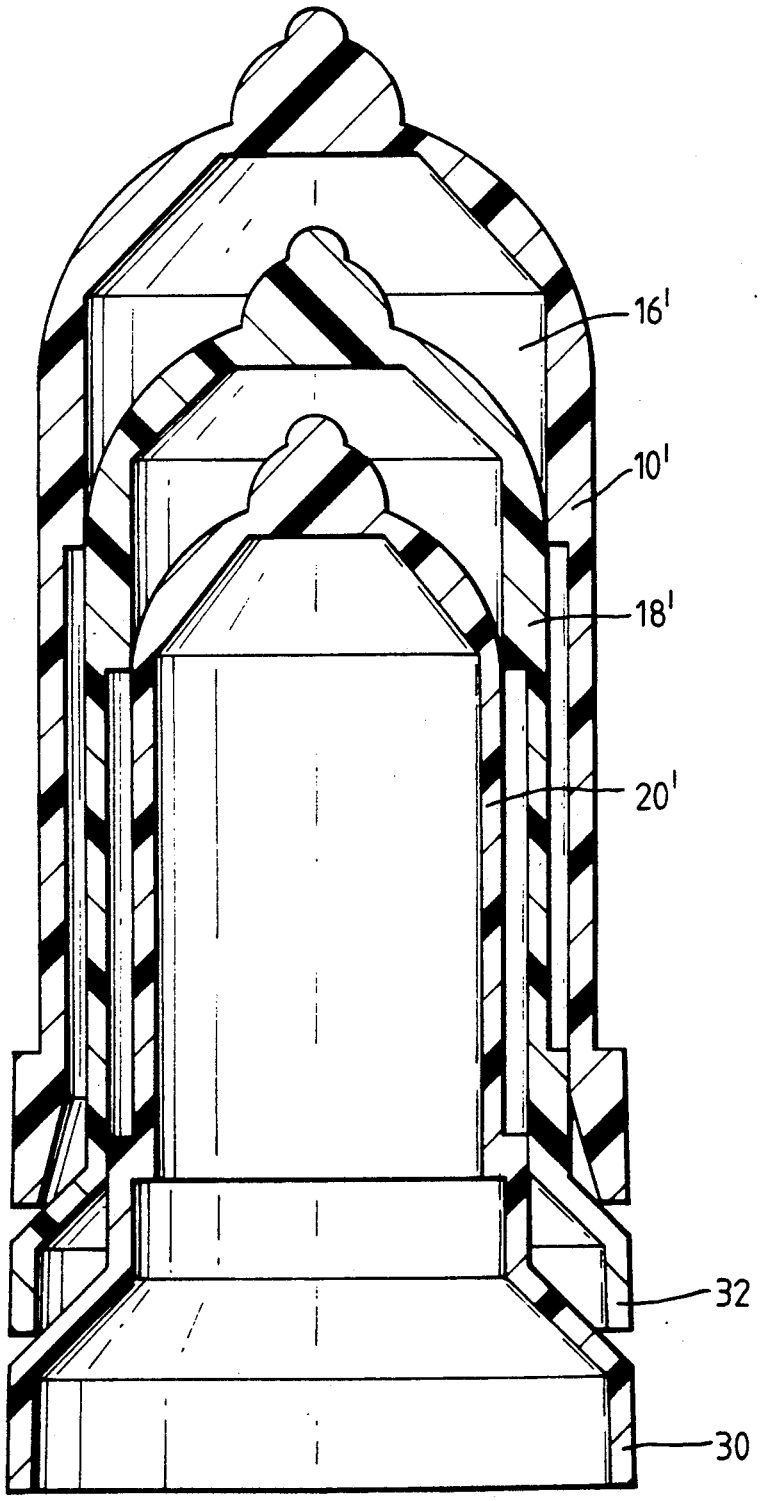
FIG. 5 is a cross-sectional view of a modification of the embodiment of FIG. 2.

FIG. 5 shows a modification of the embodiment of FIG. 2. In this embodiment the body 10' is provided with a cylindrical hollow 16'. A second spin-top 18' has dimensions which allow it free insertion into hollow 16'. A third spin-top 20' nests in the hollow of spin-top 18'. All three spin tops are preferably of similar shape. The third spin-top 20' may have a solid body without a hollow and the tops can be of different shape as long as nesting is achieved. In this embodiment, however, as will be noted the inner spin top 20' is provided with an end 30 which extends beyond the end 32 of intermediate spin top 18' which in turn, extends beyond the end of outer spin top 10' for independent activation thereof.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A foot actuatable spin-top, which comprises:

a substantially cylindrical tubular body having rotational symmetry around a longitudinal axis and configured to achieve translation from rotation around said axis while said axis is substantially in a horizontal orientation with reference to the plane of the ground on which it is spun, to rotation around said axis while said axis is substantially in a vertical orientation with reference to said plane, said body having a curved outer surface for converting a force having a vertical component applied thereto into a rotational force and a pointed end face positioned along said longitudinal axis, said top being configured to have a first rest position wherein a portion of the outer wall of said body is in direct contact with the ground, said pointed end face is elevated above the ground, and said axis is substantially parallel with the ground, an initial active position of rotation around said axis wherein outer portions of said body are still in direct contact with the ground and said pointed end face is elevated above the ground, and a second active position wherein said axis is substantially perpendicular to the ground and said pointed end face is in direct contact therewith, the configuration of said top being such that upon application by foot pressure, at a position along said body away from the pointed end face, of a spin imparting force to the curved outer wall of said body, while said spin top is in said first rest position, said body has imparted thereto a forward motion combined with a backward spin to achieve said initial active position of rotation around said axis while said axis is in a substantially horizontal orientation, the forward velocity of that part of the spin top to which foot pressure has been applied being greater than the forward velocity of said pointed end face, the immediate result being that said body has imparted thereto a simultaneous turning motion around a point along its axis, a gyroscopic reaction causing the top to assume said second active position with said top continuing to spin about said axis while said axis is substantially in a vertical orientation; and said top being further configured for use in combination with means for engaging said top for imparting said forward motion combined with said backward spin to said top while said top is in said first rest position.

2. A spin-top as claimed in claim 1, wherein the body has a hollow portion.

3. A spin-top as claimed in claim 2, which comprises a second spin top having dimensions smaller than the first spin-top and which is nested within said hollow portion, such that upon application of a force to the outer surface of said first body, said second spin-top is ejected via a second open end face by centrifugal force generated as said end face rotates relative to a point near a mid-length portion of said axis, said second spin-top being also imparted with a forward motion combined with a backward spin and a simultaneous turning motion around a point along its axis, a gyroscopic reaction causing said second spin top to assume a vertical position and said top continuing to spin about said axis.

4. A spin-top as claimed in claim 1, which comprises a multiplicity of spin-tops of progressively smaller dimensions nested within each other, at least each of the spin-tops except the smallest being hollow and provided with an open end face.

5. A spin-top as claimed in claim 4, wherein the end of an inner spin top extends beyond the end of an outer spin top for independent simultaneous activation thereof.

6. A spin-top as claimed in claim 1, wherein said body comprises a solid polyurethane polymer.

7. A foot actuable spin-top according to claim 1, wherein said body comprises at least one pointed end face, the configuration of said body being such that upon application of a force to the outer wall of said cylinder body, said cylinder body is imparted with a forward motion combined with a backward spin and a simultaneous turning motion around some point along its axis, a gyroscopic reaction causing the body to assume a vertical position and said body continuing to spin about said axis.

8. A spin-top, which comprises:

a plurality of spin-tops of progressively smaller dimensions nested within each other, at least each of the spin-tops, except the smallest spin top thereof, being hollow and provided with an open end face wherein the end of an inner spin-top extends beyond the end of an outer spin-top for independent simultaneous activation thereof, wherein at least the outer spin-top comprises a substantially cylindrical tubular body having rotational symmetry around a longitudinal axis and configured to achieve translation from rotation around said axis while said axis is substantially in a horizontal orientation with reference to the plane of the ground on which it is spun, to rotation around said axis while said axis is substantially in a vertical orientation with reference to said plane, said body having a curved outer surface for converting a force having a vertical component applied thereto into a rotational force and a pointed end face positioned along said longitudinal axis, said top being configured to have a first rest position wherein a portion of the outer wall of said body is in direct contact with the ground, said axis is substantially parallel with the ground and said pointed end face is elevated above the ground, an initial active position of rotation around said axis wherein outer portions of said body are still in direct contact with the ground and said pointed end face is elevated above the ground, and a second active position wherein said axis is substantially perpendicular to the ground and said pointed end face is in direct contact therewith, the configuration of said tops being such that upon the simultaneous application by foot pressure of a spin imparting force to the end of the outer spin top and to the ends of said inner spin tops while said spin tops are in said first rest position, each of said spin tops have imparted thereto a forward motion combined with a backward spin to achieve said initial active position of rotation around their respective longitudinal axis while said axis is in a substantially horizontal orientation, the forward velocity of said ends of said tops to which foot pressure has been applied being greater than the forward velocity of their respective pointed end faces, the immediate result being that each of said bodies has imparted thereto a simultaneous turning motion around a point along their respective axis, a gyroscopic reaction causing each of said tops to independently assume said second active position with each of said tops continuing to spin about its longitudinal axis while said axis is substantially in a vertical orientation; and said top being further configured for use in combination with means for engaging said top for imparting said forward motion combined with said backward spin to said top while said top is in said first rest position.

* * * * *